US007677213B2

(12) United States Patent
Deierlein

(10) Patent No.: US 7,677,213 B2
(45) Date of Patent: Mar. 16, 2010

(54) DEACTIVATING ROLLER FINGER FOLLOWER

(75) Inventor: Matthew J. Deierlein, Middlebury, CT (US)

(73) Assignee: Timken US LLC, Torrington, CT (US)

( * ) Notice: Subject to any disclaimer, the term of this patent is extended or adjusted under 35 U.S.C. 154(b) by 518 days.

(21) Appl. No.: 11/499,615

(22) Filed: Aug. 4, 2006

(65) Prior Publication Data

US 2007/0039573 A1 Feb. 22, 2007

Related U.S. Application Data

(60) Provisional application No. 60/705,405, filed on Aug. 4, 2005.

(51) Int. Cl.
*F01L 1/34* (2006.01)

(52) U.S. Cl. ..... 123/90.16; 123/90.39; 74/559

(58) Field of Classification Search ..... 123/90.15, 123/90.16, 90.39, 90.41, 90.42, 90.43, 90.47; 74/559

See application file for complete search history.

(56) References Cited

U.S. PATENT DOCUMENTS

| | | | | |
|---|---|---|---|---|
| 1,343,975 | A | 6/1920 | Kothny | |
| 4,768,467 | A * | 9/1988 | Yamada et al. | 123/90.16 |
| 5,544,626 | A | 8/1996 | Diggs et al. | |
| 5,619,958 | A | 4/1997 | Hampton et al. | |
| 5,623,897 | A | 4/1997 | Hampton et al. | |
| 5,653,198 | A | 8/1997 | Diggs | |
| 5,682,848 | A | 11/1997 | Hampton et al. | |
| 5,960,755 | A | 10/1999 | Diggs et al. | |
| 6,314,928 | B1 | 11/2001 | Baraszu et al. | |
| 6,604,498 | B2 | 8/2003 | Fernandez et al. | |
| 6,640,759 | B1 | 11/2003 | Hendriksma | |
| 6,769,392 | B2 | 8/2004 | Lawrence et al. | |
| 6,907,851 | B2 | 6/2005 | Barnes et al. | |
| 2003/0075129 | A1 | 4/2003 | Spath et al. | |
| 2003/0192494 | A1 | 10/2003 | Hendriksma | |
| 2003/0217728 | A1 | 11/2003 | Hasebe et al. | |

* cited by examiner

*Primary Examiner*—Zelalem Eshete
(74) *Attorney, Agent, or Firm*—Fay Sharpe LLP

(57) ABSTRACT

A deactivating roller follower assembly for deactivating an associated poppet valve for an internal combustion engine includes a body including a valve end, a pivot end, and a plunger bore. The valve end of the body is configured to contact the associated poppet valve and the pivot end of the body is configured to contact a pivot of the associated internal combustion engine. The assembly further includes a pivotable arm including a hinged end and a free end. The hinged end is rotatably mounted to the valve end of the body. The free end includes a curvilinear engaging surface for transmitting a force required to activate the associated poppet valve. In addition, the assembly includes a plunger including a latching end and a piston end. The plunger is disposed in the plunger bore in the pivot end of the body. The plunger moves between an extended position and a retracted position. The latching end of the plunger selectively engages the free end of the arm to place the arm in a latched state, whereby preventing the arm from moving relative to the body. And, the latching end of the plunger selectively disengages the free end of the arm to place the arm in an unlatched state, whereby permitting the arm to move relative to the body.

11 Claims, 8 Drawing Sheets

DEACTIVATING ROLLER FINGER FOLLOWER

A claim for domestic priority is made herein under 35 U.S.C. §119(e) to U.S. Provisional App. Ser. No. 60/705,405 filed on Aug. 4, 2005, the entire disclosure of which is incorporated herein by reference.

BACKGROUND

The present invention relates generally to the field of engine systems having valve trains capable of being deactivated hydraulically. It finds particular application in conjunction with deactivating roller followers used to deactivate individual valves in an internal combustion engine and will be described with particular reference thereto. It will be appreciated, however, that the invention is also amenable to other like applications.

Deactivating rocker arm assemblies are generally known in the art for their use in internal combustion engines and are typically used to deactivate exhaust and intake valves. This is done as part of an overall strategy to selectively deactivate one or more combustion chambers (or cylinders) of the engine to conserve fuel during idle or low load conditions. Combined with the primary benefit of not consuming fuel in the deactivated cylinders, deactivating the valves further enhances efficiency by preventing the pistons of the deactivated cylinders from using engine power to pump air through the engine.

However, a common problem involves the reliability of known deactivating rocker arm assemblies to consistently activate or deactivate a given valve upon demand. The root cause of these failures typically involve the latching components that are responsible for engaging an oscillating finger, lever, or arm and transmitting the high load forces generated by a rotating cam lobe to the stem of a valve. In some cases, the failure can be attributed to a misalignment of the latching components which inhibit positive engagement between the oscillating arm and the stationary latch of the rocker arm. Poor alignment can result from an inadequate design, poor manufacturing tolerance, and or long term wear.

Another common problem involves the manufacturability of known deactivating rocker arm assemblies. Often, the oscillating arm and other components require several machining steps (drilling, milling, grinding, turning etc.) before they can be assembled as a finished product. These additional steps increase the overall cost of the product as well the likelihood of manufacturing defects.

For these reasons, a need exists to provide an improved deactivating roller finger follower or rocker arm assembly that reduces misalignment of the latching components, decreases latch loads and associated wear while being cost effective to manufacture.

BRIEF SUMMARY OF THE INVENTION

In accordance with one aspect of the present invention, a deactivating roller follower assembly for deactivating an associated poppet valve for an internal combustion engine includes a body including a valve end, a pivot end, and a plunger bore. The valve end of the body is configured to contact the associated poppet valve and the pivot end of the body is configured to contact a pivot of the associated internal combustion engine. The assembly further includes a pivotable arm including a hinged end and a free end. The hinged end is rotatably mounted to the valve end of the body. The free end includes a curvilinear engaging surface for transmitting a force required to activate the associated poppet valve. In addition, the assembly includes a plunger including a latching end and a piston end. The plunger is disposed in the plunger bore in the pivot end of the body. The plunger moves between an extended position and a retracted position. The latching end of the plunger selectively engages the free end of the arm to place the arm in a latched state, whereby preventing the arm from moving relative to the body. And, the latching end of the plunger selectively disengages the free end of the arm to place the arm in an unlatched state, whereby permitting the arm to move relative to the body.

BRIEF DESCRIPTION OF THE DRAWINGS

The invention may take form in various components and arrangements of components. The drawings are only for purposes of illustrating one or more embodiments of the invention and are not to be construed as limiting the invention.

DETAILED DESCRIPTION

Figure 1:
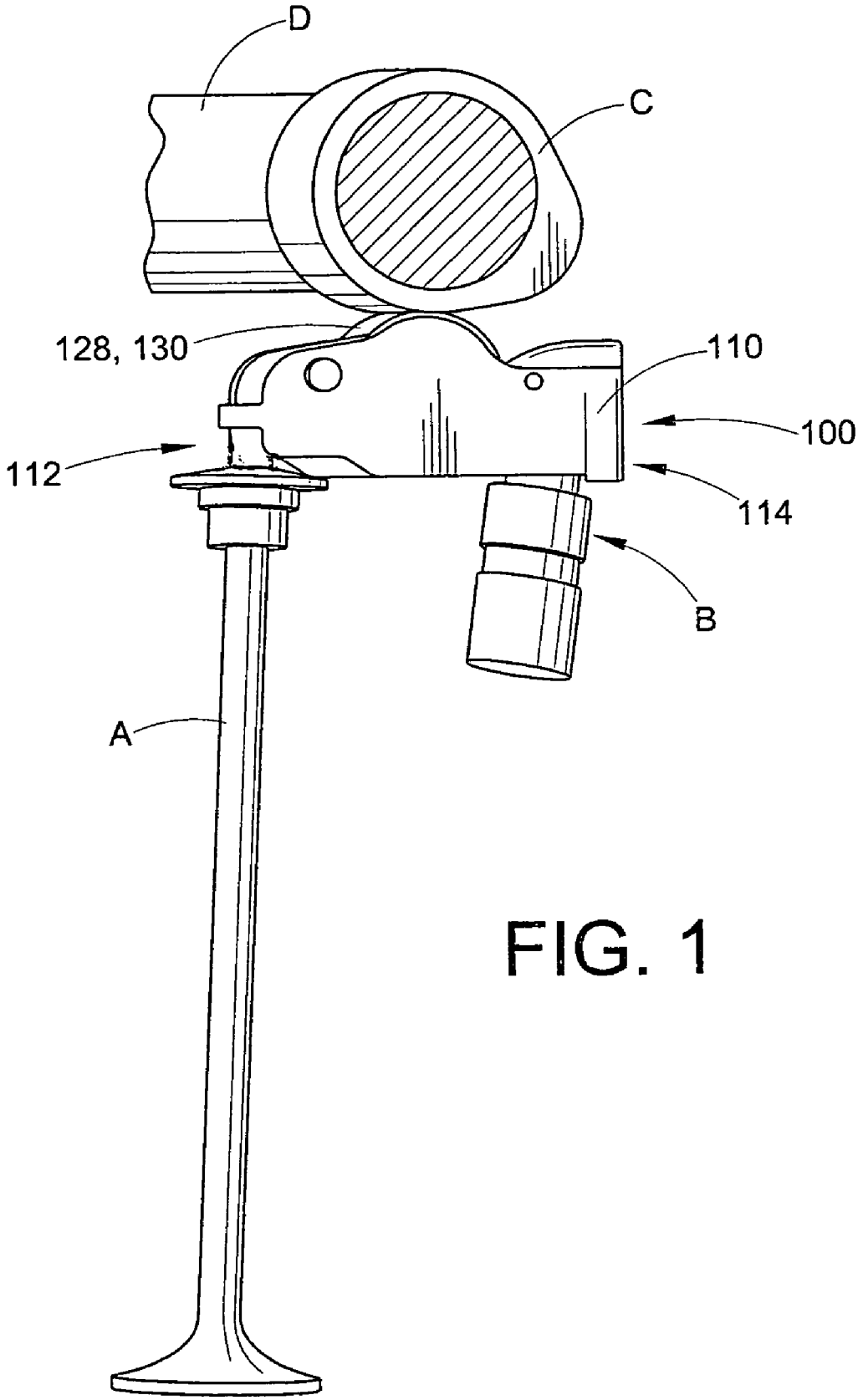
FIG. 1 is a perspective view of a first embodiment of a deactivating roller finger follower (DRFF) assembly, according to the present invention, as installed between a pivot and a poppet valve of an associated internal combustion engine.

With reference to FIGS. 1-4, a first embodiment of a deactivating roller finger follower (DRFF) assembly 100 is shown. The assembly 100 generally includes a body or housing 110 having a valve end 112 and a pivot end 114. The assembly 100 also includes an arm 116 having a hinged end 118 and a free end 120. A plunger 122 is disposed in the pivot end 114 of the body 110 and includes a latching end 124 and a piston end 126.

With particular reference to FIG. 1, the DRFF assembly is shown in a working configuration. As shown, a stem portion of a poppet valve A engages the valve end 112 of the body 110. In addition, the pivot end 114 is shown supported by a rocker pivot or hydraulic lash adjuster B. Along an upper portion of the assembly 100, a cam lobe C of a cam shaft D is shown in rolling contact with the first and second roller bearings 128, 130. During normal engine operation, the camshaft D and cam lobe C rotate urging a first and second roller bearing 128, 130 in a downward direction. Since the pivot end 114 of the body 110 is precluded from moving downward by any substantial amount due to the essentially stationary pivot B, the valve end 112 rocks downward acting against the pressure of a valve spring (not shown) to open the poppet valve A. When the valve A is deactivated, the valve end 112 of the assembly 100 does not move by any appreciable amount even thought the cam shaft D and cam lobe C are still rotating. Instead, the first and second roller bearings 128, 130 and the arm 116 begin to rock or oscillate freely within the body 110 in response to the rotating cam.

Figure 2A:
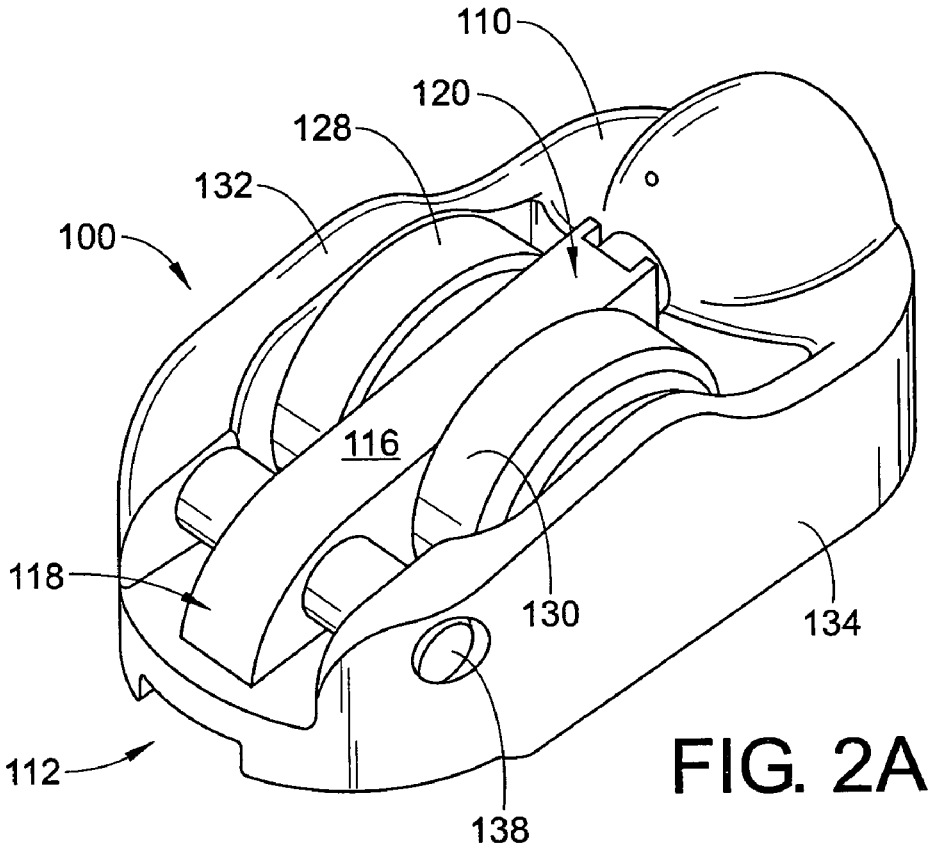
FIG. 2A is a perspective view of the DRFF assembly of FIG. 1.
Figure 2B:
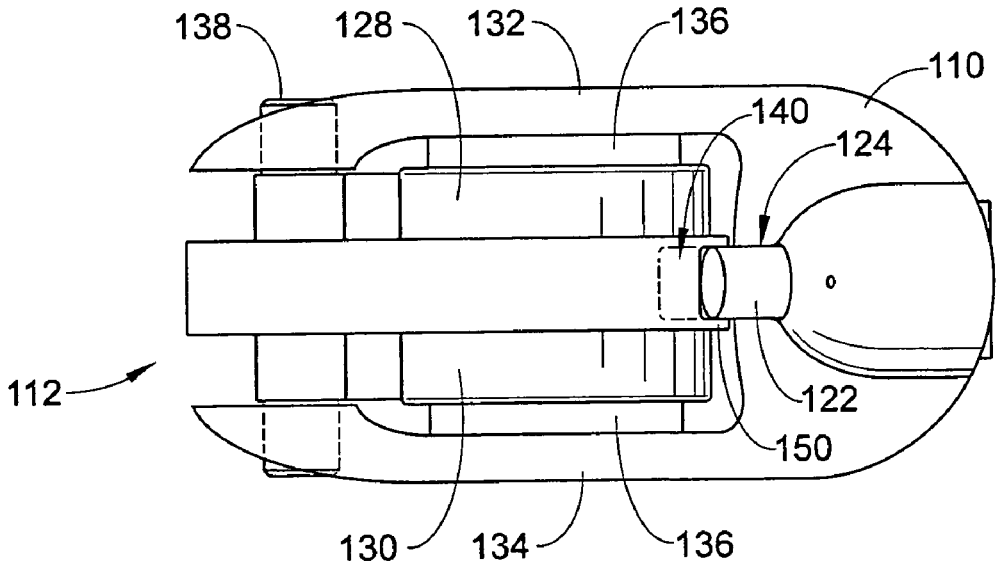
FIG. 2B is a top view of the DRFF assembly of FIG. 1, illustrating the engagement of a latching end between a pair of lateral guides.

As illustrated in FIGS. 2A-2B, the first and second roller bearings 128, 130 are disposed on either side of the arm 116. Because the cam lobe is necessarily wider than the bearings, yet must pass freely between the sidewalls 132, 134, the overall width of the first and second roller bearings 128,130 is narrower that the width between the sidewalls. As such, one or more smaller diameter thrust washers 136 are used to fill the gaps and to keep the bearings 128,130 approximately centered. The hinged end 118 of the arm 116 is pivotable about a hinge pin 138. As shown in FIGS. 2A-2B, the hinge pin 138 is mounted within the valve end 112 of the body 110 spanning from the first wall 132 to the second wall 134. As such, the arm 116 and the first and second roller bearing 128, 130 are generally pivotable as a unit about the valve end 112 of the body 110.

Whether the arm 116 may pivot is dependent upon the position of the plunger 122. Generally, the plunger 122 moves between a retracted position and an extended position. When the plunger 122 is in the extended position, it will eventually engage an aperture 140 within the arm 116. When the plunger 122 is disposed in the aperture 140, the free end 120 of the arm 116 is no longer permitted to translate in a vertical fashion and the arm is considered to be in a latched state. However, when the plunger is in the retracted position, as shown in FIG. 2B, the arm 116 will freely pivot about the hinge pin 138 and the arm is considered to be in an unlatched state.

Figure 3:
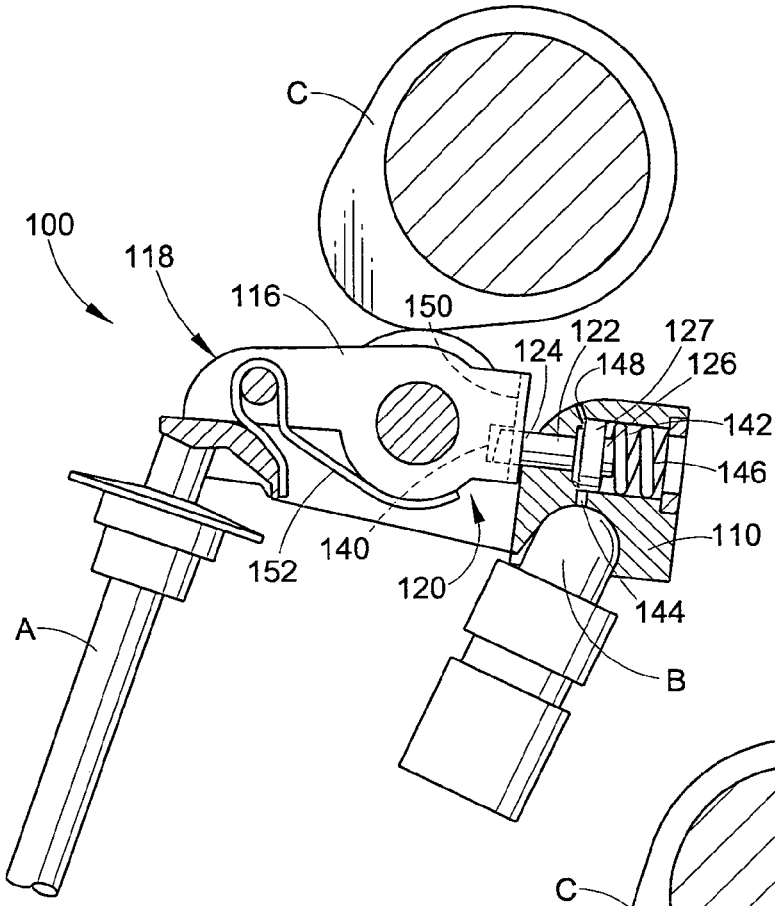
FIG. 3 is a cross-sectional view of the DRFF assembly of FIG. 1, illustrating an arm in a latched state and the associated poppet valve in an activated state.
Figure 4:
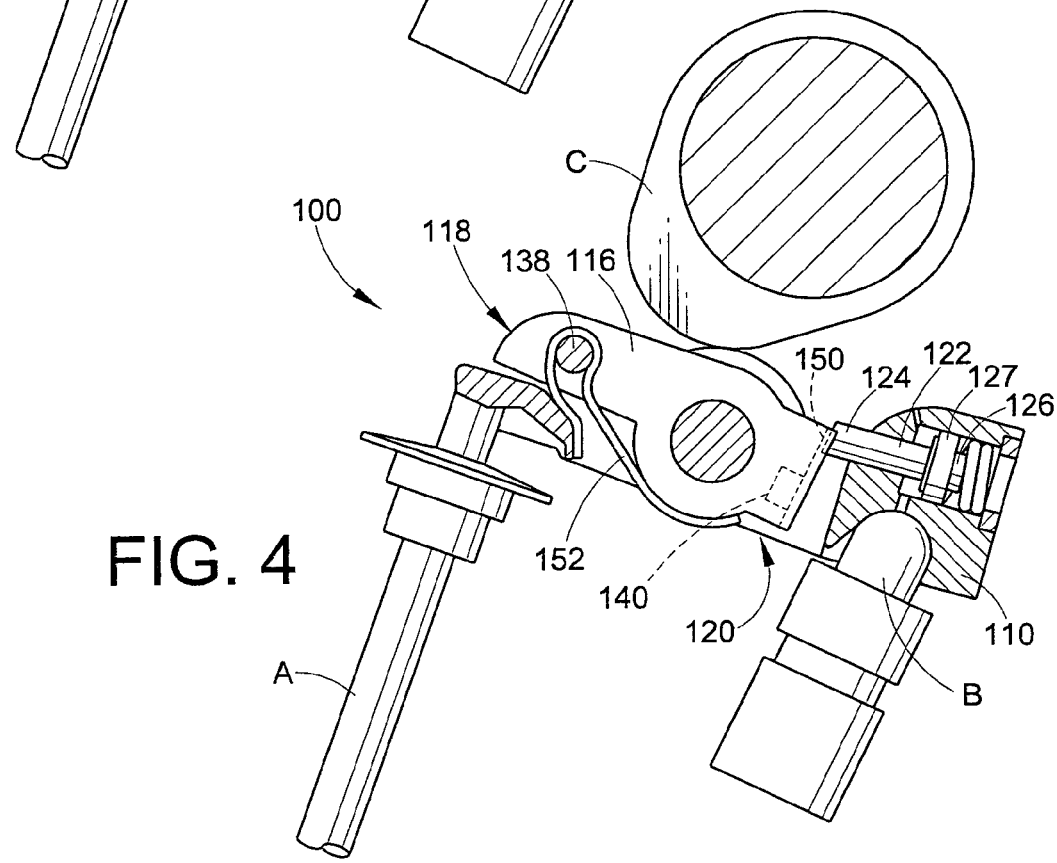
FIG. 4 is a cross-sectional view of the DRFF assembly of FIG. 1 illustrating the arm in an unlatched state and the associated poppet valve in a deactivated state.

With particular reference to FIGS. 3 and 4, the arm 116 of the DRFF assembly 100 is shown in the latched and the unlatched state, respectively. Generally, pressurized lubricating oil delivered to the assembly 100 via the rocker pivot B is used to urge the plunger 126 from the extended position to the retracted position. In order to do so, engine lube oil is fed through the rocker pivot B into a first plunger bore 142 through a feeder port 144. The oil fills a space in the first plunger bore 142 immediately preceding a piston 127 of the plunger. A bleed hole 148 allows any trapped air to escape while oil exits at a metered rate. This oil can be directed to the contact surfaces to reduce friction and wear. To cause the plunger to move and ultimately deactivate the valve A, an elevated oil pressure or flow is provided to the rocker pivot B. At this elevated oil pressure/flow (which is higher than a nominal oil pressure/flow at the pivot B), enough force is generated on the piston 127 to overcome the forward biasing plunger spring 146. As the plunger spring 146 is compressed, the latching end 124 of the plunger 122 retracts into the pivot end 114 of the body or housing 110 allowing the arm 116 to rotate freely within the body 110. When the nominal oil pressure/flow to the pivot B is restored the plunger spring eventually overcomes the oil pressure/flow and the oil within the plunger bore exits via the bleed hole 148 until the plunger comes to rest in the fully extended position.

As shown in FIG. 4, the plunger 122 is in the rearmost or retracted position. It should be noted, that even when the plunger 122 is in the retracted position, a portion of the latching end 124 is still slidably engaged with the arm 116. One or more guide ribs 150 are disposed on either side of the arm 116 and extend generally vertically along the free end 120 of the arm 116. The guides 150 form a channel which permits the latching end 124 to slide within. This slight degree of slidable engagement between the plunger 122 and the arm 116 ensures a precise lateral alignment between the latching end 124 and the arm 116 as the arm pivots about the hinge pin 138.

During normal engine operation, the cam lobe C rotates quite rapidly urging the arm 116 in a downward fashion. An arm return spring 152 continuously biases the arm 116 in an upward direction to ensure that the roller bearings 128,130 remain in rolling contact with the cam lobe C when the arm 116 is in the unlatched state. Of course, when the arm 116 is in the unlatched state, the associated poppet valve A is deactivated. Since the free end 120 of the arm 116 cannot react upon a relatively stationary surface (such as the latching end of the plunger) the motion prescribed by the cam profile or lobe C is simply lost into a rotation of the arm 116 about the hinge pin 138. Because the free end 120 of the arm 116 moves rapidly in a vertical direction with respect to the plunger 122, lateral alignment between the latching end 124 of the plunger 122 and the aperture 140 in the arm 116 is important when reactivation of the valve is required. For this reason, the guides 150 are provided to stabilize the arm 116 in at least a lateral direction. In this manner, the guides 150 also ensure proper engagement between the latching end 124 and the aperture 140 when normal oil pressure is restored to the pivot B.

Figure 5:
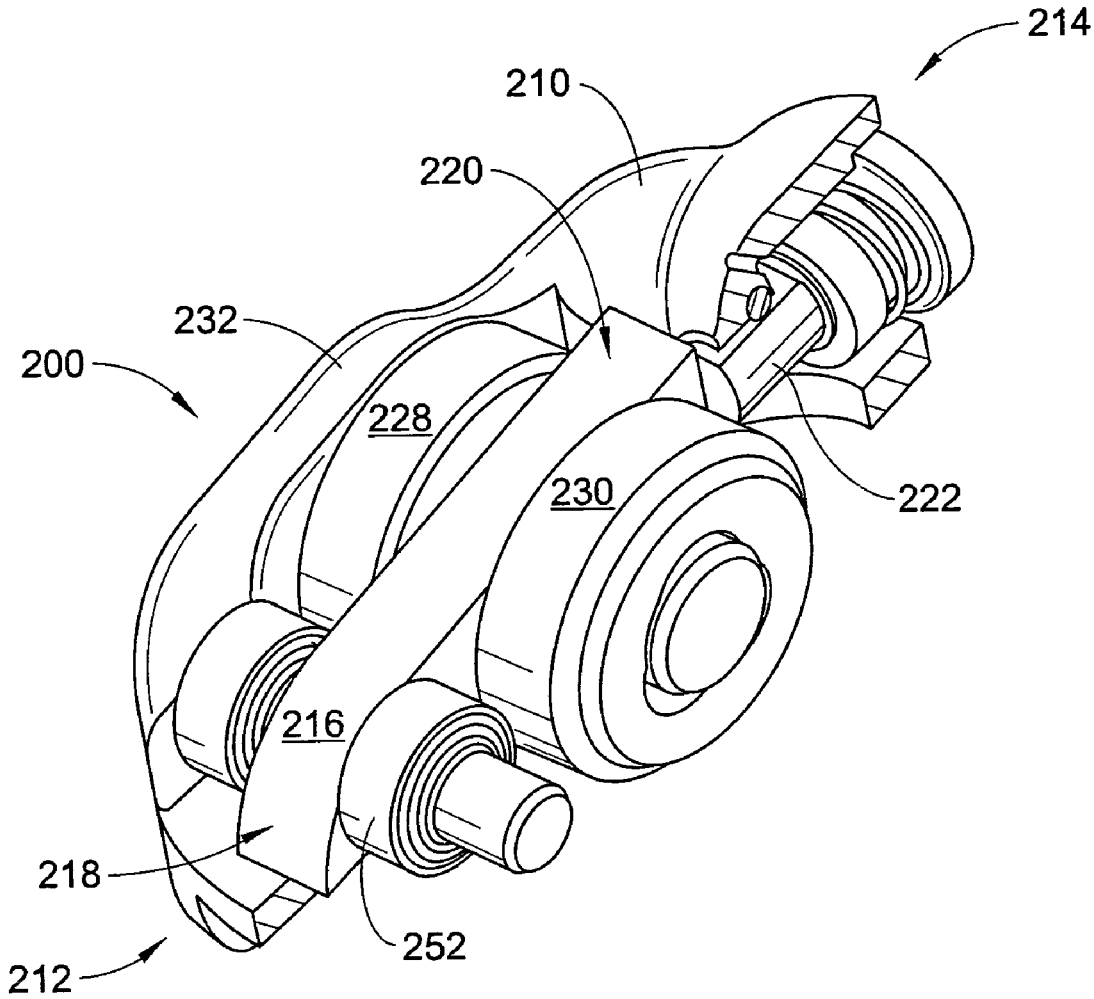
FIG. 5 is a perspective view partially in cross section of a second embodiment of a deactivating roller finger follower (DRFF) assembly, according to the present invention.
Figure 6:
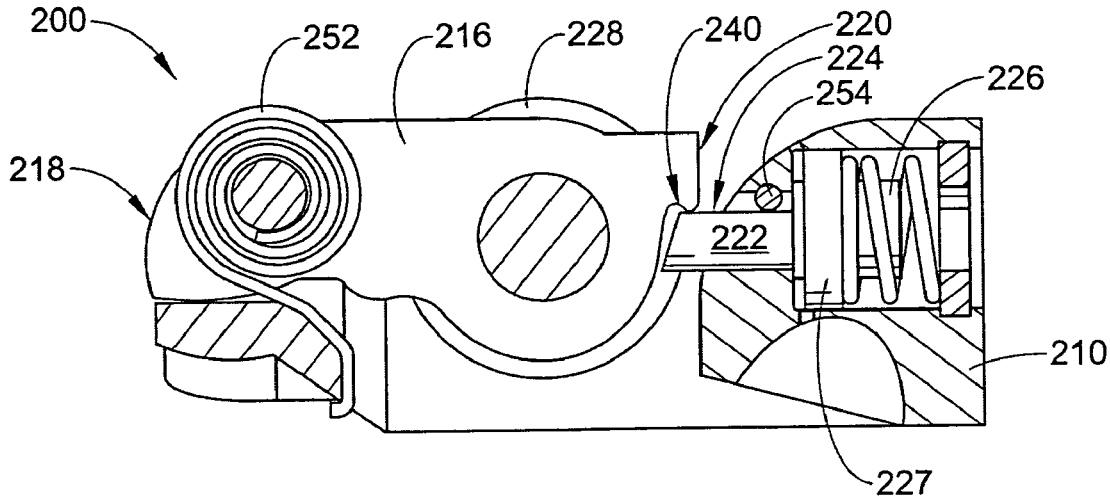
FIG. 6 is a cross-sectional view of the DRFF assembly of FIG. 5 illustrating an arm of the assembly in a latched state as well as a curvilinear engaging surface of the arm.
Figure 7:
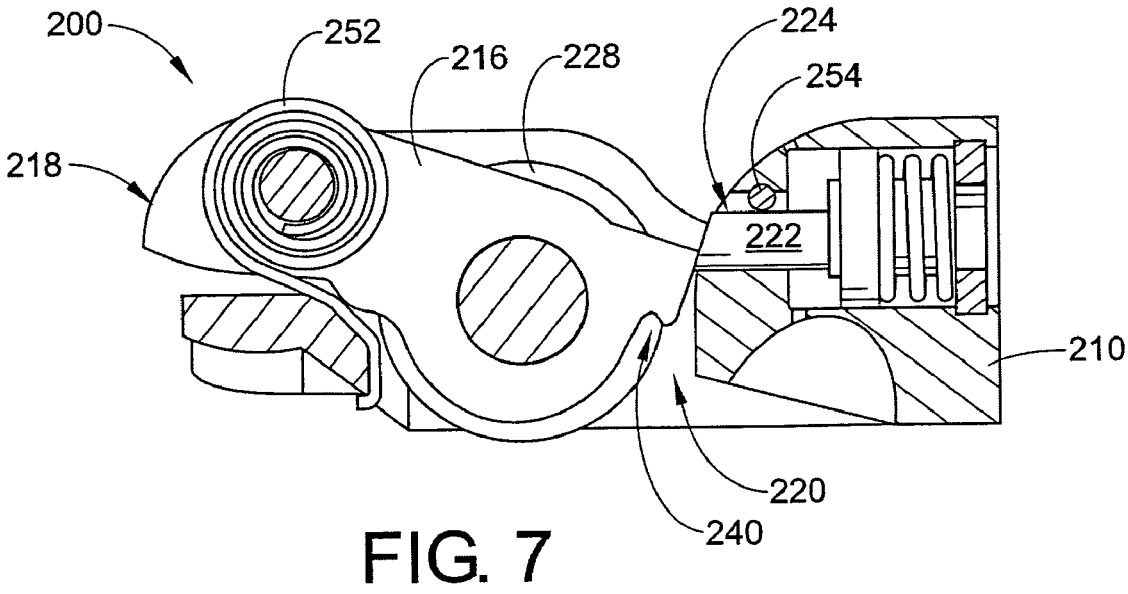
FIG. 7 is a cross-sectional view of the DRFF assembly of FIG. 5 illustrating the arm in an unlatched state and the curvilinear engaging surface of the arm.
Figure 8:
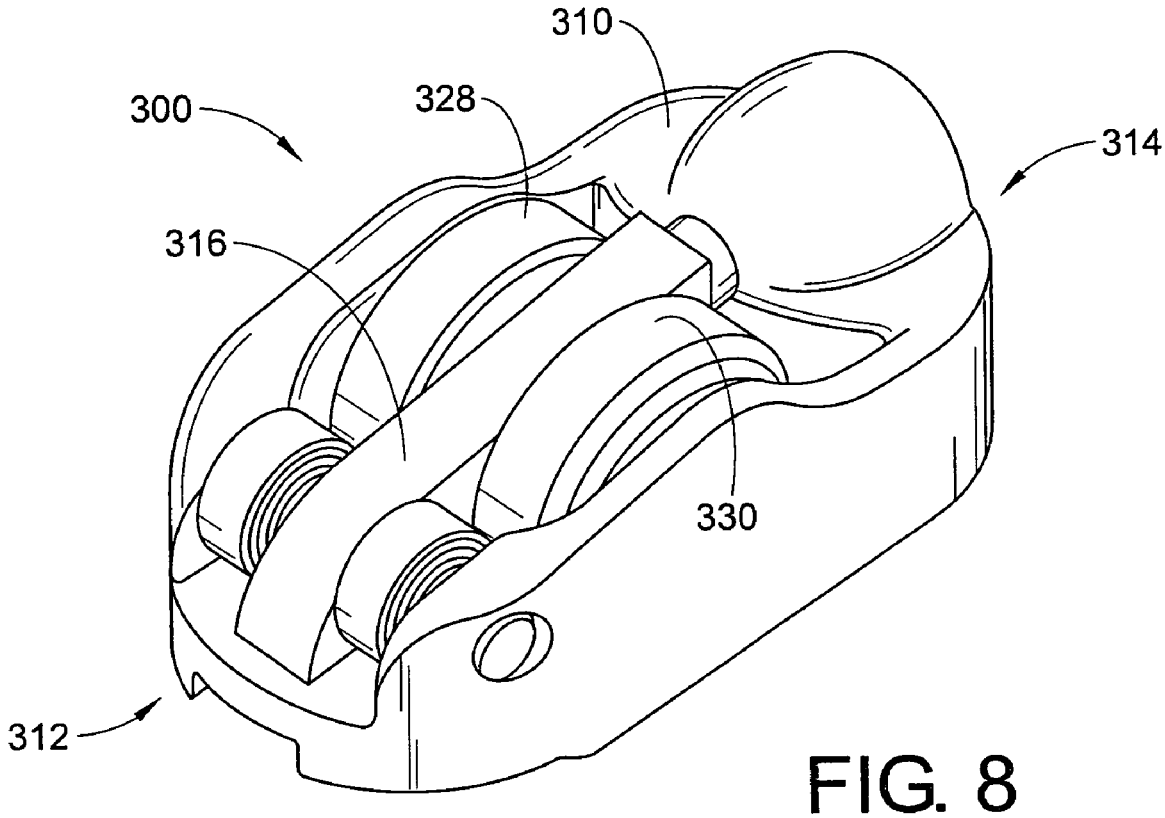
FIG. 8 is a perspective view of a third embodiment of a deactivating roller finger follower (DRFF) assembly.
Figure 9:
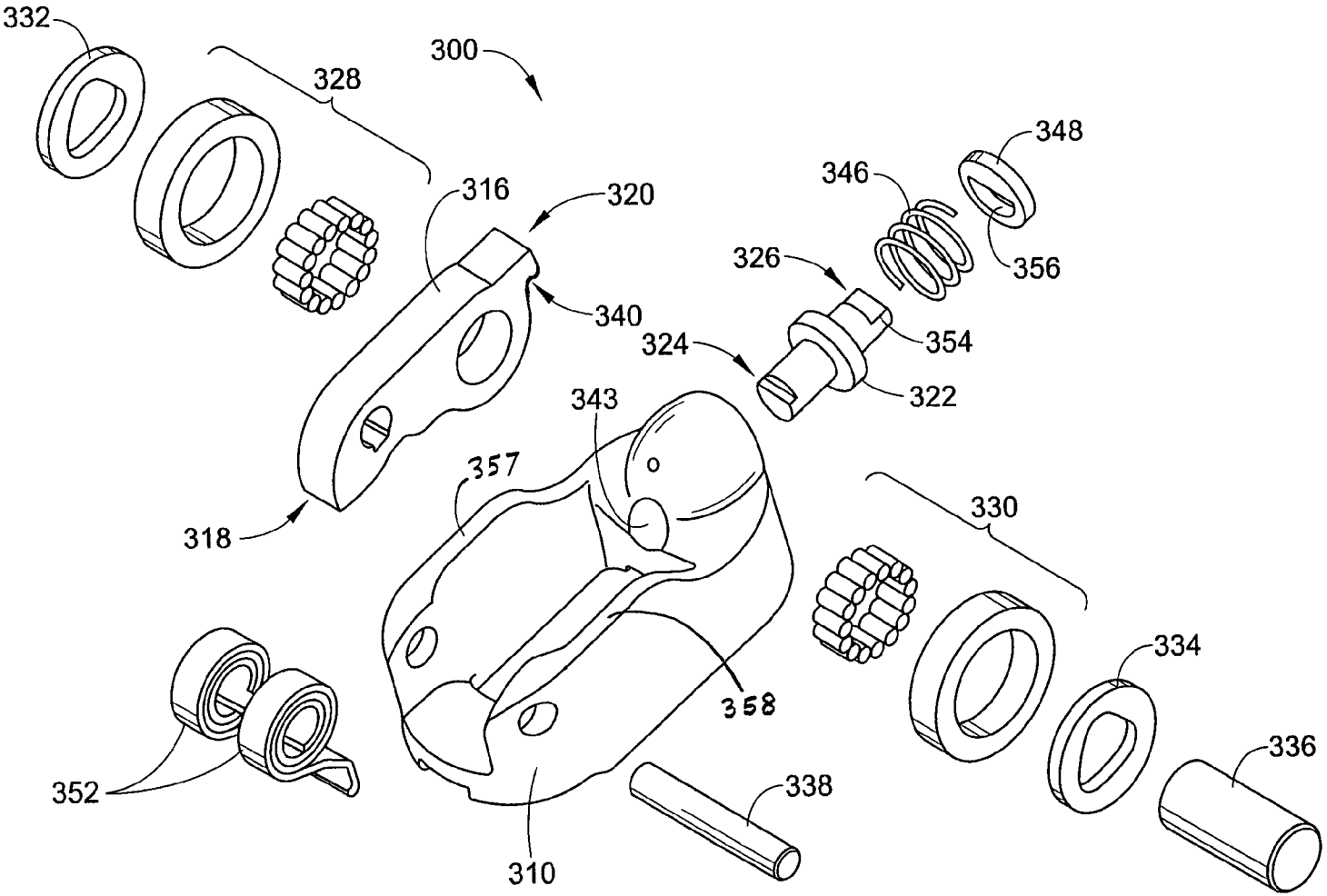
FIG. 9 is an exploded view of the DRFF assembly of FIG. 8, illustrating a coil power spring and a plunger having an anti-rotation protrusion.
Figure 10:
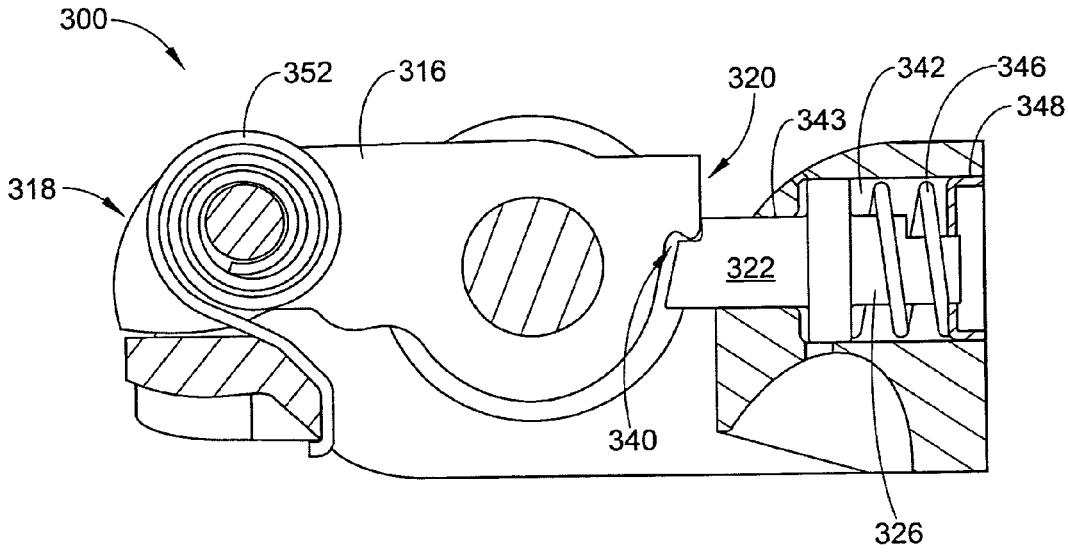
FIG. 10 is a cross-sectional view of the DRFF assembly of FIG. 8, illustrating an arm of the assembly in a latched position.
Figure 11:
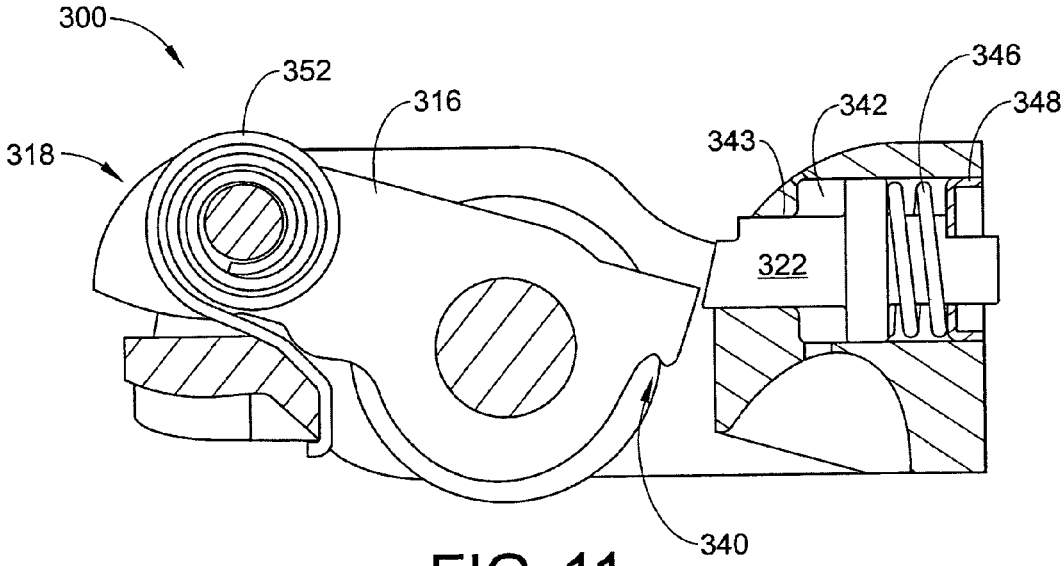
FIG. 11 is a cross-sectional view of the DRFF assembly of FIG. 8, illustrating the arm in an unlatched state.

Now with reference to FIGS. 5-7, a second embodiment of a deactivating roller finger follower assembly 200 is shown. In many respects, the overall structure of the second embodiment of the assembly 200 is similar to that of the first embodiment of the assembly. The assembly 200 operates in much the same manner as the assembly 100, which was described above. As with the first embodiment, the second embodiment of the assembly 200 includes a body or housing 210 having a valve end 212 and a pivot end 214. The assembly 200 also includes a rotatable arm 216 having a hinged end 218 and a free end 220 as well as a plunger 222 having a latching end 224 and a piston end 226. In addition, the second embodiment includes a first and second roller bearing 228, 230 disposed about the arm 216 and a first sidewall 232.

Despite the similarities, the second embodiment differs from the first embodiment in a number of respects. With reference to FIGS. 6 and 7, a first distinction involves a curvilinear latch engaging surface 240 disposed at the free end 220 of the arm 216. The curvilinear engaging surface 240 contacts the planar engaging surface of the latching end 224 of the plunger 222. The contact area defines an ellipse which remains consistent in shape even when there is variation in the angle of contact between the arm 216 and the plunger 222 due to variation in operating clearance. Thus the contact stresses are able to be controlled to a predictable and acceptable level. This elliptical contact effectively reduces the likelihood of wear or failure at this interface. Previous prior art designs involve the mating of two flat or planar engagement surfaces as between an arm and a latch, which would result in a narrow contact ellipse and high stress particularly if, for example, the edge of the arm planar engaging surface contacted the latch planar surface.

The curvilinear engaging surface 240 can also provide a drip edge for lubricating oil to collect upon while the assembly 200 is operating. This further enhances the likelihood that a lubricating pool of oil will be present during initial engagement between the free end 220 and the latching end 224 of the plunger 222.

Another distinction between the second embodiment and the first embodiment involves the use of a spirally wound torsional spring 252 which generally provides a greater amount of upward torque on the arm 216 as compared to the single layer leaf spring 152 of the first embodiment. Yet another distinction involves a dowel pin 252 that is horizontally oriented across the top surface of the latching end 224 of the plunger 222. The dowel 254 serves as an anti-rotation device to ensure that the upper surface of the latching end 224 is maintained in proper horizontal alignment with the curvilinear engaging surface 240. The dowel pin 254 is confined between the upper surface of the latching end 224 and a recess or cross drilled hole within the body 210. The dowel pin 254 placed in a horizontal orientation (as shown in FIGS. 5-7) provides a wide transverse mating surface with the upper generally flat portion of the latching end 224. This wide transverse mating surface helps to prevent rotational binding of the plunger 222 within the body 210 or any rotational/horizontal misalignment between the upper surface of the latching end 224 and the curvilinear engaging surface 240 of the arm 216.

With reference to FIGS. 8-11, a third embodiment of a deactivating roller finger follower (DRFF) assembly 300 is shown. As with the previous embodiments, the third embodiment of the assembly 300 includes a body or housing 310 having a valve end 312 and a pivot end 314. The assembly 300 also includes an arm 316 having a hinged end 318 and a free end 320 as well as a plunger 322 having a latching end 324 and a piston end 326. Furthermore, the assembly 300 includes a first and a second roller bearing 328, 330 which receive a first and second thrust washer 332, 334. The roller bearings 328, 300 and the washers 332, 334 are disposed on a bearing shaft 336 that passes through the arm 316 near its midpoint. The bearing shaft 336 can be retained axially by securing it to the arm 316, or by allowing it to float within the arm 316 and relying on contact with a first and second sidewalls 357, 358 to retain it. The fit between the bearing shaft 336 and the arm 316 can be optimized so that the shaft can rotate very slowly or "precess", preventing localized bearing wear on the shaft 336. The arm hinge pin 338 allows the arm 316 to pivot generally about the valve end 312 of the body 310. Furthermore, the arm 316 includes a curvilinear engagement surface 340 along the free end 320.

As with the second embodiment, the piston end 326 of the plunger 322 is received into a first plunger bore 342 and the latching end 324 is received into a second plunger bore 343. A plunger spring 346 reacts against a retainer member 348 to urge the plunger 322 into a forward or extended position within the pivot end 314 of the body 310. As in the second embodiment, a torsion or coil spring 352 biases the arm 316 in an upward position such that it causes the first and second roller bearings 328, 330 to maintain continuous rolling contact with a rotating cam lobe of the internal combustion engine.

A distinction between the third embodiment and the previous embodiments involves the use of an anti-rotation shoulder 354 on the piston end 326 of the plunger 322. The anti-rotation shoulder 354 shown in FIGS. 9-11 includes a semi-circular or D-shaped cross section such that it includes an upper flat surface. The D-shaped anti-rotation shoulder 354 slidably engages a similar D-shaped aperture 356 in the retainer member 348. Because the cross section of the shoulder 354 is non-circular and since the shoulder 354 engages a non-circular aperture 356, the shoulder 354 and plunger 322 are prevented from rotating within the first and second plunger bores 342,343. Of course, the cross section of the anti-rotation shoulder 354 may be of any other non-circular regular or irregular geometry (such as square, triangular, rectangular, etc). Because the plunger 322 is prevented from rotating about the longitudinal axis of the assembly 300 once again ensures that the upper flat engaging surface of the latching end 324 is horizontally/rotationally aligned with a tip portion of the curvilinear engaging surface 340.

With respect to the second and third embodiments of the present invention, it is important to note that from a manufacturing point of view the arm component is much simpler and cost effective to produce than those of other known designs. For one, all of the features required for reliable and efficient operation of the arm can be combined into a single 2-dimensional design. These features are as follows: an aperture for the hinge pin, a reaction notch for the arm spring, an engagement surface for the plunger, an aperture or support for the bearing shaft, an elongated free end portion for preventing the arm from submarining under the plunger during operation, a first stop for preventing the arm from traveling too far downward, a second stop adjacent the valve end of the body for preventing the arm from traveling too far upward, and a first and second side bearing thrust surface. This 2-dimensional profile (which includes a certain prescribed width) is easy to manufacture, allowing it to be completed via simple, cost-effective operations as, for example, by stamping, fine blanking, piercing, powder metal molding, etc.

As to the embodiments described herein, an additional advantage exists in using a dual roller bearing design for the arm as opposed to a single bearing design. In the case of a single bearing design, the bearing is usually disposed centrally within the body or arm and the latching surface is disposed at the free end of the arm just past the outer diameter of the bearing. This has the overall effect of making the deactivating rocker arm assembly longer in length. By using a dual roller bearing design, with one bearing on either side of the arm, the engaging or latching surface can be brought closer towards the valve end of the body or hinged end of the arm. Doing so keeps the overall length of the assembly as short as possible. As such, a deactivating rocker arm or roller finger follower of the present invention can fit into shorter envelopes as compared to the prior art assemblies. One example of where this is beneficial would be in retrofitting engines with deactivating rocker arms. Typically, these engines can not accommodate the longer length or larger prior art deactivating rocker arm assemblies. For this reason, the dual bearing and recessed engaging surface of the present invention is more likely to accommodate these types of engines.

It should be noted that any of the engaging surfaces or anti-rotation techniques, plunger designs, or arm biasing elements discussed herein may be combined in any manner with the embodiments previously discussed. It should also be noted that the engine oil pressure/flow actuating means discussed previously may be used not only for biasing the plunger to a rearward or retracted position, but also for biasing the plunger to a forward or extended position. This could be done by providing a separate oil feed in the rocker pivot that would communicate to an additional feeder port disposed at a rearward portion of the plunger bore. Not only would this eliminate one more component (i.e. the plunger spring) but this would have the added benefit of increasing the forward pressure of the plunger. Increasing the forward pressure of the plunger would help prevent any incidental forces from urging the plunger towards the retracted position and causing the arm to become unlatched.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A deactivating roller follower assembly for deactivating an associated poppet valve for an internal combustion engine, the assembly comprising:

a body including a valve end, a pivot end, and a plunger bore, the valve end of the body being configured to contact the associated poppet valve and the pivot end of the body being configured to contact a pivot of the associated internal combustion engine;

a pivotable arm including a hinged end and a free end, the hinged end rotatably mounted to the valve end of the body, the free end having a curvilinear latching surface for transmitting a force required to activate the associated poppet valve, the curvilinear latching surface including a convex portion, a point of inflection, and a concave portion; and a plunger including a latching end and a piston end, the plunger being disposed in the plunger bore in the pivot end of the body, the plunger moving between an extended position and a retracted position, the latching end of the plunger selectively engaging the free end of the arm to place the arm in a latched state whereby preventing the arm from moving relative to the body, the latching end of the plunger selectively disengaging the free end of the arm to place the arm in an unlatched state whereby permitting the arm to move relative to the body.

2. The deactivating roller follower assembly of claim 1, further including a roller mounted to the arm for rotating the arm in a planar fashion while in rolling contact with a rotating cam lobe of the associated internal combustion engine.

3. The deactivating roller follower assembly of claim 2, wherein the roller is disposed between a side wall of the body and the arm.

4. The deactivating roller follower assembly of claim 1, wherein the latching end of the plunger includes a complementary curvilinear engaging surface for mating against the curvilinear latching surface of the free end of the arm.

5. The deactivating roller follower assembly of claim 1, further including an anti-rotation member, the member being secured to the body and slideably engaged with the plunger.

6. The deactivating roller follower assembly of claim 5, wherein the anti-rotation member is a dowel having a generally cylindrical outer surface, the generally cylindrical outer surface of the dowel being in sliding contact with a generally flat surface of the plunger.

7. The deactivating roller follower assembly of claim 1, wherein the piston end of the plunger further includes a non-circular anti-rotation member.

8. The deactivating roller follower assembly of claim 7, wherein the anti-rotation member includes a cross section being any one of a semi-circular, oval, triangular, rectangular, or square shape.

9. The deactivating roller follower assembly of claim 7 further including a retaining member secured to the body, the retaining member including a complementary shaped opening to receive the anti-rotation member, the anti-rotation member being slidably received in the opening of the retaining member.

10. The deactivating roller follower assembly of claim 1, wherein the piston end is hydraulically driven to translate the plunger into the extended position.

11. A deactivating roller follower assembly for deactivating an associated poppet valve for an internal combustion engine, the assembly comprising:

a body including a valve end, a pivot end, and a plunger bore, the valve end of the body being configured to contact the associated poppet valve and the pivot end of the body being configured to contact a pivot of the associated internal combustion engine;

a pivotable arm including a hinged end and a free end, the hinged end rotatably mounted to the valve end of the body, the free end having a curvilinear latching surface for transmitting a force required to activate the associated poppet valve;

a plunger including a latching end and a piston end, the plunger being disposed in the plunger bore in the pivot end of the body, the plunger moving between an extended position and a retracted position, the latching end of the plunger selectively engaging the free end of the arm to place the arm in a latched state whereby preventing the arm from moving relative to the body, the latching end of the plunger selectively disengaging the free end of the arm to place the arm in an unlatched state whereby permitting the arm to move relative to the body; and wherein the latching end of the plunger includes a complementary curvilinear engaging surface for mating against the curvilinear latching surface of the free end of the arm.

* * * * *